US006227573B1

(12) United States Patent
Yorke-Zuyus

(10) Patent No.: US 6,227,573 B1
(45) Date of Patent: May 8, 2001

(54) PERSONALIZED KEEPSAKE ARTICLE OF MANUFACTURE

(76) Inventor: Denise Yorke-Zuyus, 283 Fairlawn Ave., West Hempstead, NY (US) 11552

( * ) Notice: Subject to any disclaimer, the term of this patent is extended or adjusted under 35 U.S.C. 154(b) by 0 days.

(21) Appl. No.: 09/436,032

(22) Filed: Dec. 20, 1999

(51) Int. Cl.[7] ..... B42D 15/00

(52) U.S. Cl. ..... 283/70; 283/67; 283/75; 283/77

(58) Field of Search ..... 283/67, 70, 74, 283/75, 107, 109; 156/267

(56) References Cited

U.S. PATENT DOCUMENTS

| | | | |
|---|---|---|---|
| 4,312,691 | 1/1982 | Rosenbloom, Jr. et al. | 156/267 |
| 5,380,044 | 1/1995 | Aitkens et al. | 283/70 |
| 5,784,816 | 7/1998 | Zapawa | 283/109 |

*Primary Examiner*—Willmon Fridie, Jr.
(74) *Attorney, Agent, or Firm*—Myron Amer PC

(57) ABSTRACT

A photograph-personalized card for seating attendees at a social function, such as a restaurant sit-down retirement dinner, in which the cards are positioned at the possible 2–5 tables being used for the occasion, and thus distinguishes these tables from other tables being used by other diners. The attendees are instructed that the cards, being rectangular in shape, can be used as bookmarks, thus contributing to a keepsake value.

1 Claim, 1 Drawing Sheet

PERSONALIZED KEEPSAKE ARTICLE OF MANUFACTURE

The present invention relates generally to table-designating card improvements typically used in assigning attendees at a social function to reserved seating arrangements in which, more particularly, the improvements contribute to the novelty and keepsake values of the card.

BACKGROUND OF THE INVENTION

Field of the Invention

It is already known that cards of selected end use utility, such as for example that of being a bookmark, are enhanced by being personalized. Thus, in U.S. Pat. No. 2,282,939 for "Picture And Memorandum Holder" issued to Clawson on U.S. Pat. No. 2,282,939 and in U.S. Pat. No. 5,462,006 for "Bookmark" issued to Thiruppathi on Oct. 31, 1995, the bookmark illustrated and described has provision for a compartment to receive and display in an opening of said compartment a photograph of the intended user of the bookmark.

The use of an inserted photograph for display focuses on a singular article of manufacture and is appropriate perhaps for a bookmark, but is otherwise unnecessarily limiting. For example, a reproduced likeness of a selected photograph rather than the photograph per se is perhaps not appropriate for a bookmark because a reader typically needs only one bookmark, but has utility for a wide range of other end uses.

SUMMARY OF THE INVENTION

Broadly, it is an object of the present invention to provide a dual functioning article of manufacture of a personalized nature overcoming the foregoing and other shortcomings of the prior art.

More particularly, it is an object to provide a social occasion seating card that is not discarded after its use as such, as is now the practice, but instead is retained to significantly contribute to a keepsake value.

BRIEF DESCRIPTION OF THE DRAWING

The description of the invention which follows, together with the accompanying drawings should not be construed as limiting the invention to the example shown and described, because those skilled in the art to which this invention appertains will be able to devise other forms thereof within the ambit of the appended claims.

DESCRIPTION OF THE PREFERRED EMBODIMENT

Figure 1:
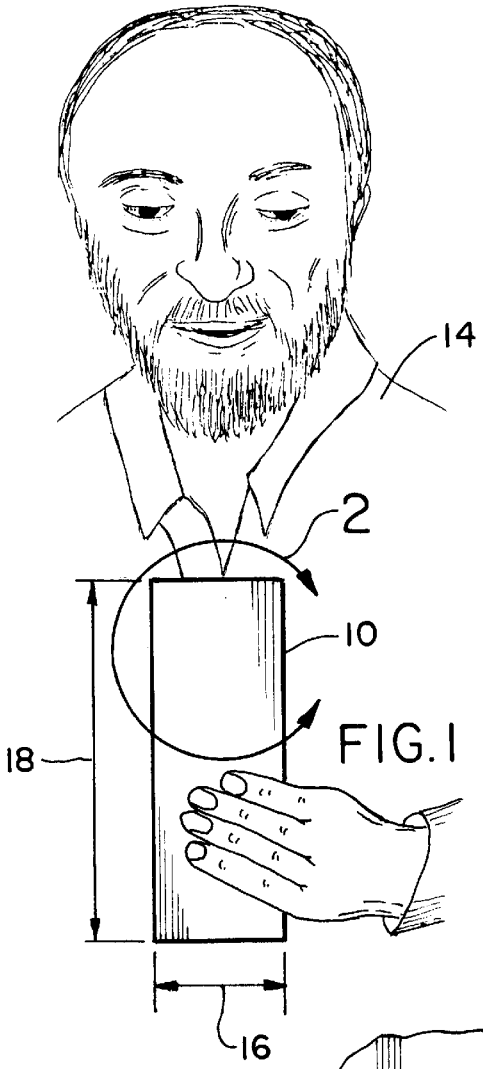
FIG. 1 is a partial front perspective view of an attendee of a social function inspecting a personalized table-designating card according to the present invention.

As known by common experience at social functions, such as a wedding, an anniversary party or, in the social occasion selected to describe the present invention, namely a retirement restaurant sit-down dinner, there is a need to use a table-designating card 10 to assist in the seating at a reserved table setting 12 of each attendee 14, whether the attendee is one of the guests or, in the social function noted, is the honoree himself. Shown in FIG. 1 is the attendee 14 inspecting a table-setting card 10 of cardboard construction material having a rectangular shape that preferably has a width 16 of 2½ inches and a length 18 of 7 inches.

Figure 2:
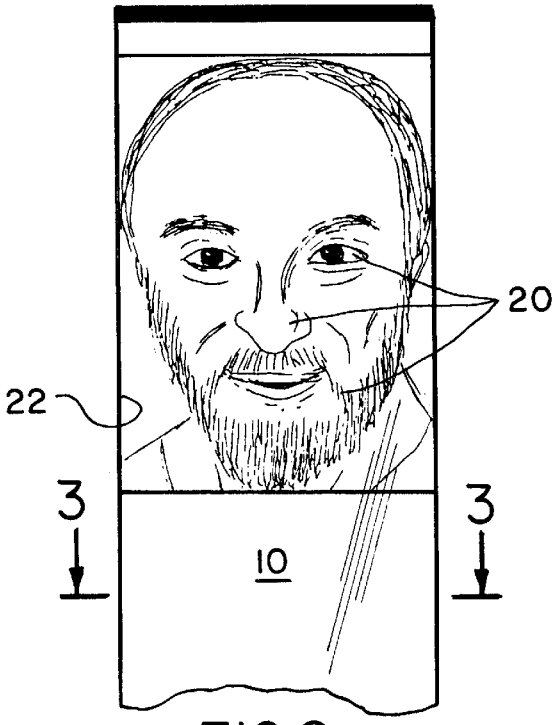
FIG. 2 is a partial view, on an enlarged scale, of the content of the card delimited by arrow 2 of FIG. 1.
Figure 3:
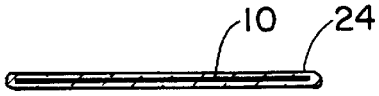
FIG. 3 is a cross sectional view, taken along line 3—3 of FIG. 2.
Figure 4:
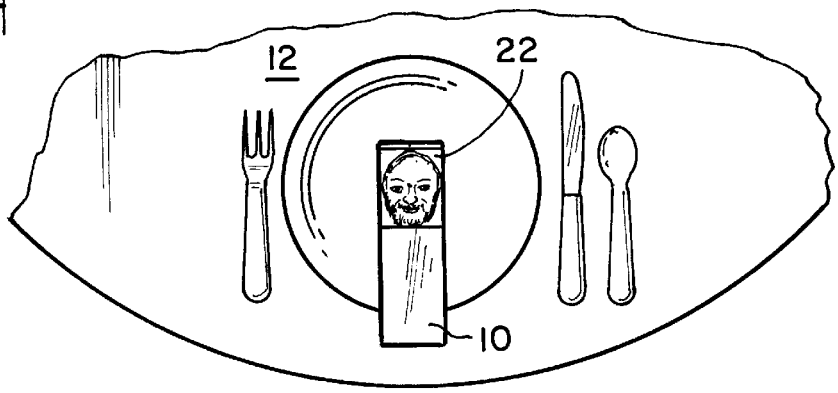
FIG. 4 is a partial perspective plan view of a table setting reserved for attendees at the social function.

As best understood from a comparison of FIGS. 1 and 2, to the upper portion of the card 10 on the side in facing relation to a viewer, the likeness of the facial features, individually and collectively designated 20, of the attendee 14, taken from a photograph (not shown), are appropriately transferred, as at 22, to the card 10, and thusly personalizes the card.

Card 10 is positioned with the attendee's photo 22 face up, in the selected restaurant, say of 15 tables, only at the place settings 12 of the 2–3 tables reserved for the retirement dinner, and thus distinguishing these seating arrangements from the remaining tables for other diners.

Each attendee is instructed that the card 10, by virtue of its rectangular shape and personalization, is to be retained and used as a bookmark after the use for seating, to thereby contribute significantly to its keepsake value. To this end, card 10 is preferably protected by a plastic film 24 to withstand the handling that would be occasioned as a bookmark.

While the dual functioning card 10 herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. In the seating of attendees at a social function in which an attendee is directed to a reserved table seat by a table-designating means, the improvement consisting of a method of personalizing said table-designating means and contributing to the keepsake value thereof comprising the steps of:

(1) providing a preliminary work-in-process flat card having a rectangular shape 2½ inches wide;

(2) obtaining a facial photograph of an attendee;

(3) transferring the likeness of said attendee from said photograph onto said rectangular card;

(4) completing said work-in-process commenced in step (1) by applying a protective clear plastic film over said rectangular card;

(5) placing said plastic-protected card at a table setting previously selected for said attendee; and (6) using said plastic-protected card after said social function as a bookmark to thereby contribute to its value as a keepsake reminder of said social function.

* * * * *